United States Patent [19]

Matsubara et al.

[11] Patent Number: 4,646,702

[45] Date of Patent: Mar. 3, 1987

[54] AIR POLLUTION PREVENTING DEVICE FOR INTERNAL COMBUSTION ENGINE

[75] Inventors: Toshio Matsubara; Hideki Kakumoto; Kazuyuki Okazaki, all of Hiroshima, Japan

[73] Assignee: Mazda Motor Corporation, Japan

[21] Appl. No.: 775,247

[22] Filed: Sep. 12, 1985

[30] Foreign Application Priority Data

Sep. 19, 1984 [JP] Japan ..... 59-197385

[51] Int. Cl.[4] ..... F02M 25/08; F02D 41/14

[52] U.S. Cl. ..... 123/520; 123/489

[58] Field of Search ..... 123/489, 518, 519, 520

[56] References Cited

U.S. PATENT DOCUMENTS 4,467,769 8/1984 Matsumura ..... 123/520 X

FOREIGN PATENT DOCUMENTS 110130 9/1976 Japan .

119949 9/1980 Japan ..... 123/520

*Primary Examiner*—Tony M. Argenbright

*Attorney, Agent, or Firm*—Gerald J. Ferguson, Jr.; Michael P. Hoffman; Ronni S. Malamud

[57] ABSTRACT

An air pollution preventing device having a canister for preventing fuel vapor formed in the fuel tank from escaping into the atmosphere is provided with a feedback control detecting circuit which detects whether the feedback control of the air-fuel ratio of intake mixture is effected, a temperature sensor which detects the fuel temperature and a purge control valve control circuit which receives outputs of the feedback control detecting circuit and the temperature sensor and controls the purge control valve so that the purge control valve is opened to permit introduction of the fuel vapor trapped in the canister only when the feedback control is effected when the fuel temperature is lower than a preset value and is opened irrespective of whether or not the feedback control is effected when the fuel temperature is not lower than the preset value.

10 Claims, 2 Drawing Figures

AIR POLLUTION PREVENTING DEVICE FOR INTERNAL COMBUSTION ENGINE

BACKGROUND OF THE INVENTION

1. Field of the Invention

This invention relates to an air pollution preventing device for an internal combustion engine which prevents fuel vapor formed in the fuel tank from being discharged into the air.

2. Description of the Prior Art

There have been known air pollution preventing devices for preventing fuel vapor formed in the fuel tank from being discharged into the air in which the fuel vapor is first trapped by a canister and then purged from the canister and introduced into the intake system of the engine under the force of intake vacuum. However, when the trapped fuel vapor is turbulently introduced into the intake system, the air-fuel ratio of the intake mixture introduced into the cylinders fluctuates by a large amount which adversely affects combustion in the cylinders and adversely affects, in the case of an engine having a catalytic converter in the exhaust system, the cleaning performance of the catalytic converter. Therefore, in some of the known air pollution preventing devices of this type, a pressure responsive valve is provided to control the amount of fuel vapor to be purged from the canister and introduced into the intake system by the intake vacuum of the engine so that the amount is increased as the intake vacuum of the engine is enhanced, thereby restricting change in the air-fuel ratio of the intake mixture caused by the fuel vapor.

However, it is difficult to precisely control the air-fuel ratio by controlling the amount of the fuel vapor to be introduced into the intake system by means of the pressure responsive valve. There is disclosed in Japanese Unexamined Patent Publication No. 51(1976)-110130 an air pollution preventing device in which a system for trapping fuel vapor by use of a canister and feeding the trapped vapor fuel to the intake system is combined with an air-fuel ratio control mechanism for effecting feedback control of the air-fuel ratio based on the output of an exhaust sensor provided in the exhaust passage, and the air-fuel ratio is controlled by the air-fuel ratio control mechanism while the trapped fuel vapor is purged from the canister into the intake system, whereby the air-fuel ratio can be controlled precisely even during the purging of the trapped fuel vapor from the canister.

However, practically, the feedback control of the air-fuel ratio based on the output of the exhaust sensor is effected only in the low-speed, light-load operating range of the engine in which exhaust performance is apt to be deteriorated, and is not effected in other operating ranges in order to increase engine output power. Accordingly, in order to restrict change in the air-fuel ratio brought about by the fuel vapor introduced into the intake system from the canister by means of feedback control based on the output of the exhaust sensor as in the device disclosed in the above Japanese unexamined patent publication, the feedback control range in which the feedback control of the air-fuel ratio is to be effected and the fuel vapor purging range in which fuel vapor trapped in the canister is to be purged therefrom and introduced into the intake system must overlap each other. This requires a purge control valve which is opened or closed in response to whether or not the feedback control is effected.

However, in the conventional air pollution preventing devices, there arises various problems described later due to lack of consideration relating to the formation of fuel vapor and the control characteristics of the feedback control based on the output of the exhaust sensor in the following points.

(1) The amount of fuel vapor formed in the fuel tank increases as the fuel temperature rises, and the amount of fuel vapor purged from the canister into the intake system increases with the increase in the fuel temperature.

(2) When the air-fuel ratio is feedback-controlled, if the control value, i.e., the correction value of the fuel feeding amount, is excessively large, it takes a long time for the air-fuel ratio to return to the preset value (e.g., the stoichiometric value), thereby adversely affecting the control response, and at the same time, the fuel feeding means can practically reduce the fuel only by a limited amount. Therefore, the maximum control value is generally set so as not to cause a large delay in control response, and if the control value is to exceed the maximum value, the control value is fixed at the maximum value even in the feedback control range. In this case, the amount of fuel fed to the engine from the fuel feeding means such as a fuel injector is fixed at a minimum. (This condition will be referred to as "fuel-feed-ceiling", hereinbelow.)

(3) The amount of fuel fed to the intake system of the engine is the sum of the amount of fuel fed from the fuel feeding means (this part of fuel will be referred to as "main fuel", hereinbelow) and the amount of fuel vapor purged from the canister. Therefore, in order to fix the amount of fuel to be fed to the engine, the amount of the main fuel must be reduced as the amount of the fuel vapor purged from the canister increases.

Accordingly, when the fuel temperature is increased, increasing the amount of fuel vapor purged from the canister, and the amount of the main fuel is reduced with the increase in the amount of purged fuel vapor, the control value is apt to go to the maximum value to reduce the amount of the main fuel by the maximum amount, that is, the fuel-feed-ceiling is apt to occur. When the control value is fixed at the maximum value, the feedback control of the air-fuel ratio is interrupted and the purge control valve is closed to interrupt the purging of fuel vapor.

On the other hand, when the operating range of the engine is changed to a high-speed, heavy-load range by depression of the accelerator pedal while the control value is fixed at the maximum value, and then reverts to the feedback control range, the air-fuel ratio of the intake mixture in the intake passage is lowered and the control value is reduced below the maximum value, and at the same time, the feedback control is started again and the purge control valve is opened to start purging of fuel vapor from the canister again. That is, when the accelerator pedal is repeatedly depressed and released while the fuel temperature is high, the feedback control of the air-fuel ratio is repeatedly effected and interrupted and the purge control valve is repeatedly opened and closed, causing surging, whereby durability of the purge control valve is deteriorated and the operating performance of the engine is adversely affected since the air-fuel ratio fluctuates between rich and lean.

SUMMARY OF THE INVENTION

In view of the foregoing observations and description, the primary object of the present invention is to provide an air pollution preventing device for an internal combustion engine in which purging of fuel vapor from the canister into the intake system is controlled by a purge control valve and the air-fuel ratio of the intake mixture is feedback-controlled on the basis of the output of an exhaust sensor, which device can prevent the surging of the purge control valve which is apt to occur when the fuel temperature is high and the amount of fuel vapor formed in the fuel tank is relatively large, thereby improving durability of the purge control valve and operating performance of the engine.

The air pollution preventing device in accordance with the present invention is provided with a feedback control detecting means which detects whether the feedback control is effected or the feedback control means is operating, a temperature sensor which detects the fuel temperature or a temperature related to the fuel temperature (in this specification, the term "fuel temperature" broadly includes any temperatures related to the fuel temperature), and a purge control valve control means which receives the output of the feedback control detecting means and the temperature sensor and controls the purge control valve so that the purge control valve is opened to permit introduction of the fuel vapor trapped in the canister only when the feedback control is being effected when the fuel temperature is lower than a preset value and is opened irrespective of whether the feedback control is being effected when the fuel temperature is not lower than the preset value.

In accordance with the present invention, when the fuel temperature is high, where the amount of fuel vapor formed in the fuel tank is large and the feedback control of the air-fuel ratio is repeated due to repeated operation of the accelerator pedal, the purge control valve is kept opened and accordingly surging of the purge control valve is prevented.

DESCRIPTION OF THE PREFERRED EMBODIMENT

Figure 1:
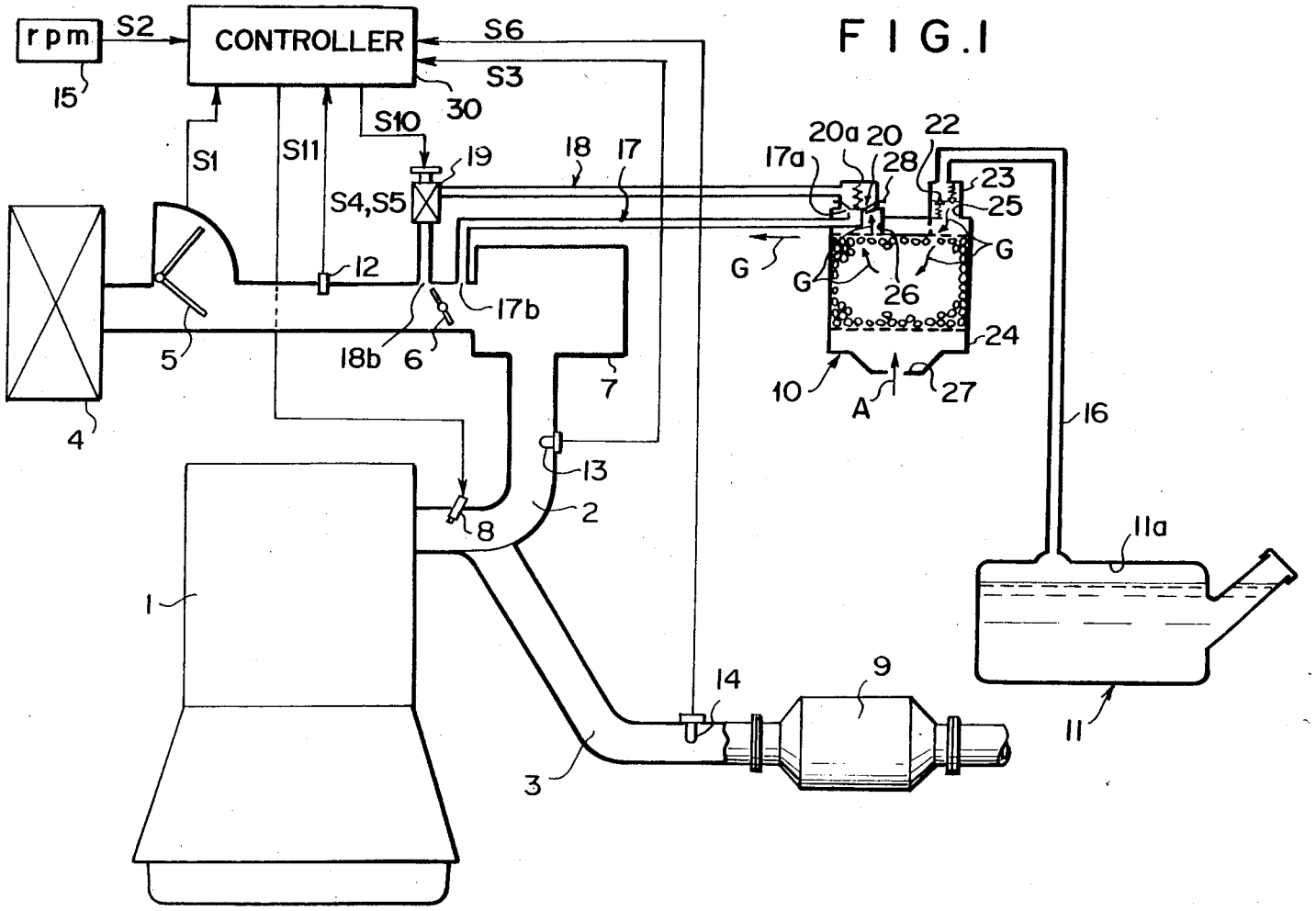
FIG. 1 is a schematic view showing an internal combustion engine provided with an air pollution preventing device in accordance with an embodiment of the present invention.

In FIG. 1, an engine 1 is provided with an intake passage 2 and an exhaust passage 3. An air cleaner 4, an airflow meter 5, an intake air temperature sensor 12, a throttle valve 6, a surge tank 7, a boost sensor 13 and a fuel injector 8 are provided along the intake passage 2. The airflow meter 5 detects the amount of intake air and outputs an intake air amount signal S1. The intake air temperature sensor 12 detects the temperature of the intake air and outputs a low temperature signal S4 when the temperature of the intake air is lower than a preset value which is 53° C. in this particular embodiment and a high temperature signal S5 when the temperature of the intake air is not lower than the preset value. The intake air temperature sensor 12 is for detecting the fuel temperature by means of the intake air temperature which is related to the fuel temperature. A boost sensor 13 detects the boosting pressure in the intake passage 2 and outputs a boost signal S3.

The exhaust passage 3 is provided with a catalytic converter 9, and an oxygen sensor 14 (as the exhaust sensor) is provided in the exhaust passage 3 upstream of the catalytic converter 9. The oxygen sensor 14 detects the oxygen concentration in the exhaust from the engine 1 and outputs an oxygen concentration signal S6.

A fuel tank 11 is connected to the intake passage 2 by way of a canister 10 comprising a casing 24 filled with activated charcoal. Fuel vapor G formed in the fuel tank 11 is absorbed by the activated charcoal in the canister 10 and is purged therefrom into the intake passage 2 in a known manner. The canister 10 is provided, in the top wall of the casing 24, with a fuel vapor inlet 25 which is communicated with an upper space **11*a* in the fuel tank 11 by way of a fuel vapor passage 16. The fuel vapor passage 16 is connected to the fuel vapor inlet 25 by way of a pair of check valves 22 and 23 which are disposed side by side and arranged to permit flows in opposite directions. A fuel vapor outlet 26 is formed in the top wall of the casing 24 of the canister 10 and is connected to the intake passage 2 between the throttle valve 6 and the surge tank 7 by way of a fuel vapor purging passage 17. The fuel vapor purging passage 17 is provided with a valve seat 28 which is formed on one end 17*a* of the fuel vapor purging passage 17 and opens in the fuel vapor outlet 26 of the canister 10, and is connected to the intake passage 2 at the other end 17*b* thereof which opens in the intake passage 2 downstream of the throttle valve 6 and upstream of the surge tank 7. On the valve seat 28 is mounted a diaphragm type pressure responsive valve 20 which is actuated under the force of intake vacuum introduced by way of an intake vacuum introduction passage 18. The intake vacuum introduction passage 18 opens (18*b*) in the intake passage 2 in a suitable position upstream of the throttle valve 6 so that the pressure responsive valve 20 is actuated to open the valve seat 28 under the force of intake vacuum transmitted thereto by way of the intake vacuum introduction passage 18 when the engine load is heavier than a preset value and otherwise keeps the valve seat 28 closed. In this embodiment, the intake vacuum introduction passage 18 opens (18*b*) at a position which is disposed upstream of the throttle valve 6 when it is fully closed, and is disposed downstream of the throttle valve 6** when it is opened by a preset angle.

The intake vacuum introduction passage 18 is further provided with a purge control valve 19 which opens and closes the intake vacuum introduction passage 18 under the control of a valve opening signal S10 from a controller 30 to be described later. The fuel vapor purging passage 17 is opened and closed by the purge control valve 19 by way of the pressure responsive valve 20.

The controller 30 receives the intake air amount signal S1 from the airflow sensor 5, an engine rpm signal S2 from an engine speed sensor 15, the boost signal S3 from the boost sensor 13, the low temperature signal S4 or the high temperature signal S5 from the intake air temperature sensor 12, and the oxygen concentration signal S6 from the oxygen sensor 14, and delivers the control signal S10 to the purge control valve 19, and at the same time, delivers an injector driving signal S11 to the fuel injector 8 to control the amount of fuel to be injected.

Figure 2:
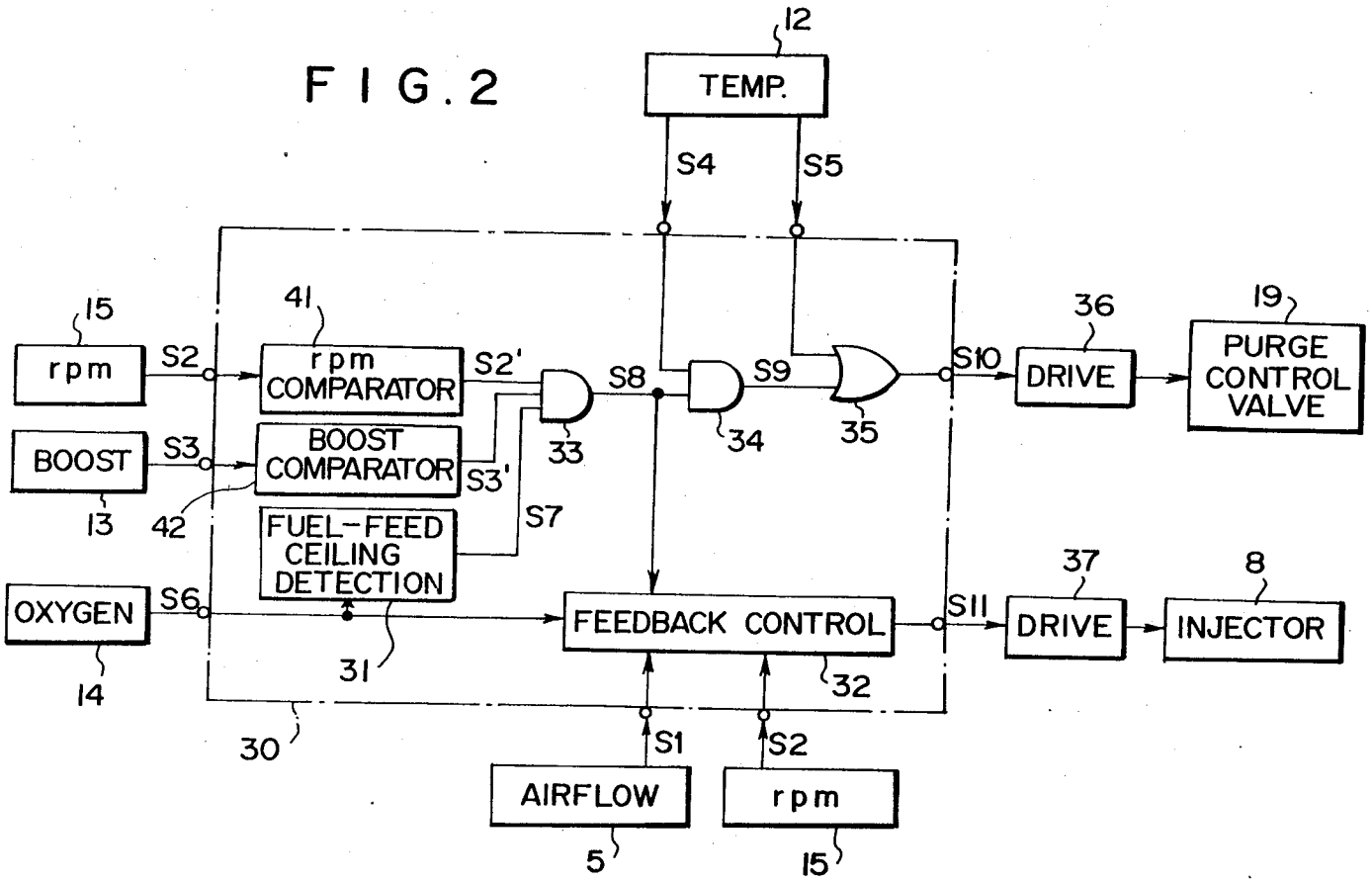
FIG. 2 is a block diagram of a controller employed in the air pollution preventing device shown in FIG. 1.

FIG. 2 shows the block diagram of the controller 30. The controller 30 comprises a fuel-feed-ceiling detecting circuit 31, a feedback control circuit 32, a first AND circuit 33, a second AND circuit 34, and an OR circuit 35.

The fuel-feed-ceiling detecting circuit 31 receives the oxygen concentration signal S6 from the oxygen sensor 14 and determines whether the operating condition of the engine 1 is in the fuel-feed-ceiling range in which the amount of main fuel to be fed to the engine 1 from the fuel injector 8 is fixed at the minimum value on the basis of the difference between the preset air-fuel ratio and the detected air-fuel ratio represented by the oxygen concentration signal S6. The fuel-feed-ceiling detecting circuit 31 determines that the operating condition of the engine is not in the fuel-feed-ceiling range or that feedback control of the air-fuel ratio by the feedback control circuit 32 may be effected, and outputs a feedback control permitting signal S7 only when the difference between the preset air-fuel ratio and the detected air-fuel ratio is smaller than a preset value.

The feedback control circuit 32 receives the oxygen concentration signal S6 from the oxygen sensor 14, the intake air amount signal S1 from the airflow meter 5 and the engine rpm signal S2 from the engine speed sensor 15, and controls the amount of the main fuel to be injected from the fuel injector 8. The feedback control circuit 32 effects feedback control on the amount of main fuel to be injected from the injector 8 to converge the air-fuel ratio on the preset air-fuel ratio (substantially equal to the stoichiometric value) on the basis of the oxygen concentration signal S6 only when a feedback control effecting signal S8 is input into the feedback control circuit 32 from the first AND circuit 33. The feedback control circuit 32, which otherwise does not effect the feedback control even if the oxygen concentration signal S6 is input, delivers the injector driving signal S11 to a driving circuit 37 for the fuel injector 8 to control the amount of fuel to be injected from the fuel injector 8 according to the engine load represented by the intake air amount signal S1 and the engine rpm signal S2 without feeding back the air-fuel ratio actually obtained.

The first AND circuit 33 receives a low rpm signal S2' which is generated from an rpm comparator 41 when the engine rpm represented by the engine rpm signal S2 output from the engine rpm sensor 15 is lower than a preset engine rpm, a low boosting pressure signal S3' which is generated from a boosting pressure comparator 42 when the boosting pressure represented by the boost signal S2 output from the boost sensor 13 is lower than a preset boosting pressure (when both the low rpm signal S2' and the low boosting pressure signal S3' are simultaneously output, the operating condition of the engine 1 is considered to be in the low-speed, light load range in which the feedback control of the amount of the main fuel to be injected from the injector 8 is to be effected), and the feedback control permitting signal S7 which is generated from the fuel-feed-ceiling detecting circuit 31, and outputs the feedback control effecting signal S8 only when the three signals S2', S3' and S8 are simultaneously input thereinto.

The second AND circuit 34 outputs a purge signal S9 for purging trapped fuel vapor from the canister 10 when the low temperature signal S4 (indicating that the actual temperature of the intake air is lower than 53° C.) from the intake air temperature sensor 12 and the feedback control signal S8 from the first AND circuit 33 are simultaneously input into the second AND circuit 34.

The OR circuit 35 receives the purge signal S9 from the second AND circuit 34 and the high temperature signal S5 (indicating that the actual temperature of the intake air is not lower than 53° C.) from the intake air temperature sensor 12, and delivers the valve opening signal S10 to a driving circuit 36 for the purge control valve 19 to open the purge control valve 19 when at least one of the signals S9 and S5 is input into the OR circuit 34.

In this particular embodiment, the fuel-feed-ceiling detecting circuit 31 and the first AND circuit 33 form said feedback control detecting means and the first and second AND circuits 33 and 34 and the OR circuit 35 form said purge control valve purge means as will become apparent later.

When the temperature of the intake air is lower than the preset temperature, that is, when the temperature of fuel in the fuel tank 11 is relatively low and the amount of fuel vapor formed in the fuel tank 11 is relatively small, the manner of control depends upon whether the feedback control effecting signal S8 is output from the first AND circuit 33. That is, when the operating condition of the engine is in the feedback control range and the fuel-feed-ceiling is not detected (that is, the amount of main fuel to be injected from the fuel injector 8 is not fixed at the minimum value, though the fuel-feed-ceiling seldom occurs when the temperature of fuel is low and the amount of fuel vapor formed in the fuel tank 11 is relatively small), the feedback control effecting signal S8 is output from the first AND circuit 33 and the purge signal S9 is output from the second AND circuit 34. Accordingly, the purge control valve 19 is opened so that the fuel vapor trapped in the canister 10 is purged from the canister 10 and introduced into the intake passage 2, and at the same time, the feedback control of the air-fuel ratio is effected on the basis of the oxygen concentration signal S6 from the oxygen sensor 14.

On the other hand, when the operating condition of the engine is not in the feedback control range and/or the fuel-feed-ceiling is detected when the fuel temperature is lower than the preset temperature, the feedback control effecting signal S8 is not output from the first AND circuit 33. Accordingly, the purge control valve 19 is kept closed so that the fuel vapor trapped in the canister 10 is not purged therefrom, and the air-fuel ratio is controlled simply according to the engine load, without feedback.

When the temperature of the intake air is not lower than the preset temperature, that is, when the temperature of fuel in the fuel tank 11 is relatively high and the amount of fuel vapor formed in the fuel tank 11 is relatively large (in this case, the fuel-feed-ceiling is apt to occur), the high temperature signal S5 is input into the OR circuit 35 from the intake air temperature sensor 12. Accordingly, the purge control valve 19 is opened so that the fuel vapor trapped in the canister 10 is purged therefrom and introduced into the intake passage 2 irrespective of whether the feedback control is being effected.

The feedback control circuit 32 selectively effects the feedback control or the control without feedback depending upon whether the feedback control effecting signal S8 is output from the first AND circuit 33 and regardless of the temperature of the intake air. That is, the feedback control circuit 32 determines that the fuel-feed-ceiling is not detected when the feedback control effecting signal S8 is output and effects the feedback control of the air-fuel ratio on the basis of the oxygen concentration signal S6 output from the oxygen sensor 14. On the other hand, when the feedback control effecting signal S8 is not output, the feedback control circuit 32 determines that the fuel-feed-ceiling is detected and controls the air-fuel ratio without feedback irrespective of the oxygen concentration signal S6.

The fuel-feed-ceiling is released by a depression of the accelerator pedal, changing the operating condition of the engine from the low-speed, light-load range in which the feedback control of the air-fuel ratio is effected to the high-speed, heavy-load range, and then releasing the accelerator pedal to return the operating condition to the low-speed, light-load range or the feedback control range. Therefore, when the accelerator pedal is repeatedly depressed and released, feedback control and control without feedback are alternately repeated.

However, in the embodiment described above, the purge control valve 19 is kept open when the fuel temperature is high irrespective of whether the feedback control is effected. Therefore, the purge control valve 19 is not repeatedly opened and closed even if the feedback control is repeatedly effected and interrupted and accordingly surging of the purge control valve 19 can be prevented.

In the embodiment described above, the temperature of the intake air is detected instead of the fuel temperature. However, the temperature of the fuel in the fuel tank 11 may be detected directly or the ambient temperature may be detected instead.

We claim:

1. An air pollution preventing device for an internal combustion engine comprising a feedback control means for controlling the air-fuel ratio of intake mixture to converge on a preset value in a particular operating range of the engine according to an output of an exhaust sensor provided in the exhaust system of the engine, a canister for trapping fuel vapor formed in a fuel tank, a purge control valve which is opened to permit purging of the trapped fuel vapor from the canister and introduction of the same into the intake system of the engine, a feedback control detecting means for detecting that the feedback control means is operating, a temperature detecting means for detecting the fuel temperature in the fuel tank, and a purge control valve control means which opens the purge control valve when the feedback control means is operating and the fuel temperature in the fuel tank is lower than a preset value while opening the same when the fuel temperature in the fuel tank is not lower than the preset value irrespective of whether the feedback control means is operating.

2. An air pollution preventing device as defined in claim 1 in which said temperature detecting means detects the fuel temperature in the fuel tank from the temperature of intake air.

3. An air pollution preventing device as defined in claim 1 further comprises a feedback control permitting means which receives an engine rpm signal from an engine speed sensor, an engine load signal from an engine load sensor and a minimum-fuel-feed signal from a minimum-fuel-feed detecting means which detects that the amount of main fuel to be fed to the engine has been fixed at a minimum value, and outputs a feedback control permitting signal when the operating condition of the engine is in a predetermined low-speed, light-load range and the amount of main fuel to be fed to the engine is not fixed at the minimum value.

4. An air pollution preventing device as defined in claim 3 further comprising means for detecting that the engine speed is lower than a preset value and means for detecting that the engine load is lighter than a preset value, the preset values of the engine speed and the engine load defining said predetermined low-speed, light-load range.

5. An air pollution preventing device as defined in claim 4 in which said exhaust system of the engine is provided with a catalytic converter, said exhaust sensor is an oxygen sensor for measuring the oxygen concentration in the exhaust gas upstream of the catalytic converter, and said minimum-fuel-feed detecting means determines that the amount of main fuel to be fed to the engine has been fixed at a minimum value when the difference between the preset air-fuel ratio and the actual air-fuel ratio derived from the oxygen concentration in the exhaust gas measured by the oxygen sensor is larger than a predetermined value.

6. An air pollution preventing device as defined in claim 1 in which said feedback control means receives outputs from an engine speed sensor for detecting the engine rpm and an engine load sensor for detecting the engine load, and operates when the operating condition of the engine is in a predetermined low-speed, light-load range, the predetermined low-speed, light-load range being said particular operating range of the engine.

7. An air pollution preventing device as defined in claim 6 further comprising means for detecting that the engine speed is lower than a preset value and means for detecting that the engine load is lighter than a preset value, the preset values of the engine speed and the engine load defining said predetermined low-speed, light-load range.

8. An air pollution preventing device as defined in claim 1 in which said canister is connected to the intake system by way of a purge passage which is connected to the intake system downstream of the throttle valve at one end and to a fuel vapor outlet of the canister at the other end, a pressure responsive valve means is provided to open and close the purge passage under the force of the intake vacuum exerted thereon by way of an intake vacuum introduction passage, and said purge control valve is provided in the intake vacuum introduction passage to control the intake vacuum exerted on the pressure responsive valve means.

9. An air pollution preventing device as defined in claim 8 in which said intake vacuum introduction passage opens in the intake system at a position which is disposed upstream of the throttle valve when it is fully closed, and is disposed downstream of the throttle valve when it is opened by a preset angle.

10. An air pollution preventing device for an internal combustion engine, comprising a purge control valve which is opened to permit introduction of fuel vapor formed in the fuel tank of the engine into the intake system of the engine and is closed to prevent the same, an engine speed sensor for detecting the engine rpm, an intake vacuum sensor for detecting the engine load through the intake vacuum, a catalytic converter provided in the exhaust system of the engine, an exhaust sensor provided in the exhaust system upstream of the catalytic converter, an airflow meter for detecting the amount of intake air flowing in the intake passage of the intake system an intake air temperature sensor which detects the intake air temperature and outputs a low temperature signal when the intake air temperature is lower than a preset value and a high temperature signal when the intake air temperature is not lower than the preset value, a feedback control means which receives the output of the exhaust sensor and effects feedback control to converge the actual air-fuel ratio derived from the output of the exhaust sensor on a preset air-fuel ratio, a minimum fuel-feed-detecting means which receives the output of the exhaust sensor and determines that the amount of main fuel fed to the engine has been fixed at a minimum value when the difference between the actual airfuel ratio derived from the output of the exhaust sensor and the preset air-fuel ratio is larger than a predetermined value, a feedback control permitting means which receives the outputs of the engine speed sensor, the intake vacuum sensor and the minimum-fuel-feed detecting means and outputs a feedback control permitting signal when the operating condition of the engine derived from the output of the engine speed sensor and the intake vacuum sensor is in a predetermined low-speed, light-load range, and the amount of main fuel fed to the engine is not fixed at the minimum value, and a purge control valve control means which receives the outputs of the feedback control permitting means and the intake air temperature sensor, and opens the purge control valve only when the feedback control permitting signal is input when the low temperature signal is input from the intake air temperature sensor, and opens the purge control valve irrespective of the feedback control permitting signal when the high temperature signal is input from the intake air temperature sensor.

* * * * *